US008936452B2

(12) United States Patent
Refenius et al.

(10) Patent No.: US 8,936,452 B2
(45) Date of Patent: Jan. 20, 2015

(54) PUMP HOUSING

(75) Inventors: Viktor Refenius, Wetzlar (DE); Rolf Popelka, Moerfelden-Walldorf (DE)

(73) Assignee: Ixetic Bad Homburg GmbH, Bad Homburg (DE)

( * ) Notice: Subject to any disclaimer, the term of this patent is extended or adjusted under 35 U.S.C. 154(b) by 560 days.

(21) Appl. No.: 12/670,547

(22) PCT Filed: Jul. 17, 2008

(86) PCT No.: PCT/EP2008/005823

§ 371 (c)(1),
(2), (4) Date: Jan. 25, 2010

(87) PCT Pub. No.: WO2009/012921

PCT Pub. Date: Jan. 29, 2009

(65) Prior Publication Data

US 2010/0189586 A1 Jul. 29, 2010

(30) Foreign Application Priority Data

Jul. 25, 2007 (DE) ..... 10 2007 036 552

(51) Int. Cl.
*F04C 2/348* (2006.01)
*F04C 2/344* (2006.01)
*F04C 14/06* (2006.01)

(52) U.S. Cl.
CPC ..... *F04C 2/344* (2013.01); *F04C 14/06* (2013.01); *F04C 2240/30* (2013.01)
USPC ..... 418/268; 418/259

(58) Field of Classification Search
USPC ..... 417/435, 204, 410.3, 199.2, 200; 418/13, 259, 96, 261, 258, 30
See application file for complete search history.

(56) References Cited

U.S. PATENT DOCUMENTS

| | | | | | |
|---|---|---|---|---|---|
| 2,475,844 | A | * | 7/1949 | Jones | 418/216 |
| 3,824,040 | A | * | 7/1974 | Aronson | 417/204 |
| 3,901,628 | A | * | 8/1975 | Bornholt et al. | 417/299 |
| 4,386,891 | A | * | 6/1983 | Riefel et al. | 418/81 |
| 4,869,648 | A | * | 9/1989 | Wall et al. | 417/206 |

FOREIGN PATENT DOCUMENTS

| | | | | |
|---|---|---|---|---|
| GB | 103199 | * | 1/1917 | 417/204 |
| GB | 169229 | | 9/1921 | |
| GB | 2097475 | | 11/1982 | |
| JP | 59126095 | | 7/1984 | |
| SU | 950956 | | 8/1982 | |

* cited by examiner

*Primary Examiner* — Alexander Comley
(74) *Attorney, Agent, or Firm* — Cozen O'Connor

(57) ABSTRACT

A pump housing, in particular a vane cell pump housing, having a suction connection point, from which a suction channel emerges which opens with a suction-channel opening into a receiving chamber in the pump housing, and having a pressure connection point, from which a pressure channel emerges which opens at a pressure-channel opening into the receiving chamber. The invention is distinguished by the fact that the suction connection point, the pressure connection point, the suction-channel opening and/or the pressure-channel opening are/is arranged in such a way that a minimum level of a conveying fluid which is present in the receiving chamber is not undershot in different installation situations.

7 Claims, 4 Drawing Sheets

PUMP HOUSING

PRIORITY CLAIM

This is a U.S. national stage of application No. PCT/EP2008/005823, filed on Jul. 17, 2008 which claims priority to the German Application No.: 10 2007 036 552.9, Filed: Jul. 25, 2007; the content of both incorporated herein by reference.

FIELD OF THE INVENTION

The invention pertains to a pump housing, especially a vane cell pump housing, with a suction connection point, from which a suction channel proceeds. The suction channel has a suction channel opening leading to a receiving chamber in the pump housing and a pressure connection point, from which a pressure channel proceeds. The pressure channel has a pressure channel opening leading to the receiving chamber.

SUMMARY OF THE INVENTION

A goal of the invention is to create a pump housing, especially a vane cell pump housing having a suction connection point from which a suction channel proceeds, which has a suction channel opening leading to a receiving chamber in the pump housing, and with a pressure connection point, from which a pressure channel proceeds having a pressure channel opening leading to the receiving chamber, namely, a pump housing that provides trouble-free operation in various installation situations, especially the trouble-free starting of a pump especially a vane cell pump, equipped with the inventive pump housing.

A goal of the invention is achieved in that the suction connection point, the pressure connection point, the suction channel opening, and/or the pressure channel opening is/are arranged such that, regardless of the installation situation, the pumped fluid present in the receiving chamber does not fall below a certain minimum level. As a result, a siphon effect is possible that allows the quasi-self-priming operation of a pump, especially of a vane cell pump, equipped with the inventive pump housing. The receiving chamber holds a rotary assembly, which comprises, a rotor with vanes, a contour ring, and at least one side plate. The suction connection point, the pressure connection point, the suction channel opening, and the pressure channel opening are preferably arranged and/or coordinated with each other such that, regardless of how the pump is installed, the amount of pumped fluid present in the receiving chamber does not fall below the minimum level. The suction connection point comprises a suction connection opening externally on the housing. The pressure connection point comprises a pressure connection opening externally on the housing. The housing is preferably of a one-piece design.

A preferred exemplary embodiment of the pump housing is characterized in that the pressure channel opening is arranged in an end wall of the pump housing which forms a boundary of the receiving chamber and is located within a radius which is smaller than the circumference of the receiving chamber. The pressure channel opening can, for example, make it possible for the fluid to be supplied underneath the vanes. The pressure channel opening is preferably arranged in a recess in the end wall of the pump housing. The radius mentioned above is preferably smaller than the radius of the rotor of a pump, especially a vane cell pump, equipped with the inventive pump housing.

Another preferred exemplary embodiment of the pump housing is characterized in that the pressure channel comprises another pressure channel opening, which is arranged in the circumferential wall of the pump housing forming a boundary of the receiving chamber. The two pressure channel openings are connected to each other by the pressure channel. The additional pressure channel opening makes it possible for the pumped fluid which has been put under pressure during the operation of a pump, especially a vane cell pump, equipped with the inventive pump housing to drain off into the receiving chamber.

In another embodiment of the invention, the pump housing is characterized in that the pressure connection point is connected by a pressure connecting channel to a pressure connection area, which connects the end of the pressure connecting channel facing away from the pressure connection point to the additional pressure channel opening. The pressure connecting channel is part of the pressure channel. Another pressure connection area connects the pressure connecting channel to the first-mentioned pressure channel opening.

In another embodiment of the invention, the pump housing is characterized in that the end of the pressure connecting channel facing away from the pressure connection point and the pressure connection point are arranged radially outside of, and axially offset from, the circumferential wall of the pump housing forming a boundary of the receiving chamber. The pressure connecting channel extends outside the receiving chamber.

In another embodiment of the invention, the pump housing is characterized in that the suction channel opening is arranged in the circumferential wall of the pump housing forming a boundary of the receiving chamber. The suction channel opening makes it possible for the pumped fluid to flow into the receiving chamber.

In another embodiment of the invention, the pump housing is characterized in that the suction connection point is connected by a suction connecting channel to a suction connection area, which connects the end of the suction connecting channel facing away from the suction connection point to a suction channel opening. The suction connecting channel is part of the suction channel.

In another embodiment of the invention, the pump housing is characterized in that the end of the suction connecting channel facing away from the suction connection point and the suction connection point are arranged radially outside of, and axially offset from, the circumferential wall of the pump housing forming a boundary of the receiving chamber. The suction connecting channel extends outside the receiving chamber.

In another embodiment of the invention, the pump housing is characterized in that the suction connecting channel is parallel to the pressure connecting channel. The connecting channels have the shape of tubes, for example, which are connected integrally to the pump housing.

In another embodiment of the invention, the pump housing is characterized in that the suction connecting channel and the pressure connecting channel extend in the same plane, which is parallel to the end wall of the pump housing forming a boundary of the receiving chamber. The longitudinal axes of the connecting channels, which are designed as bores, for example, preferably extend in the plane just mentioned.

BRIEF DESCRIPTION OF DRAWINGS

Additional advantages, features, and details of the invention can be derived from the following description, in which various exemplary embodiments are described in detail with reference to the drawing.

DETAILED DESCRIPTION OF THE PREFERRED EMBODIMENTS

Figure 1:
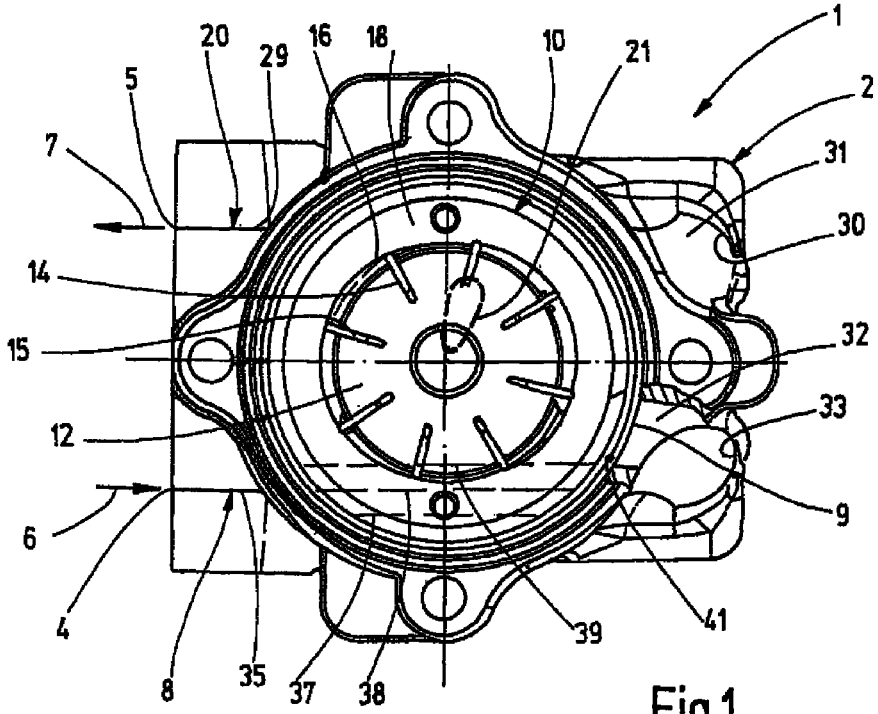
FIGS. 1-5 are top views of a rotor arranged in the pump housing of a vane cell pump with an inventive pump housing in various installation positions.

The invention described in the following pertains both to vane cell pumps and to roller cell pumps. The following description is based on vane cell pumps by way of example. FIGS. 1-8 show various views of a vane cell pump 1 in various installation situations.

The vane cell pump 1 comprises a pump housing 2 with a suction connection point 4 and a pressure connection point 5. The arrow 6 indicates that the conveyed medium is drawn into the pump housing 2 at the suction connection point 4. The conveyed medium is preferably an oil such as diesel fuel. The oil can also be a hydraulic oil. The conveyed medium, which is also referred to as the pumped fluid, is put under pressure in the pump housing 2. The pressurized pumped fluid leaves the pump housing 2 via the pressure connection point 5, as indicated by the arrow 7.

From the suction connection point 4, there extends a suction channel 8 through the pump housing 2 to a suction channel opening 9, at which the suction channel 8 opens out into a receiving chamber 10 for a rotary assembly. The rotary assembly comprises a rotor 12, which is driven by a drive shaft (not shown). The circumferential surface of the rotor 12 is provided with radially oriented slots, in which vanes 14, 15, are guided with a certain freedom of movement. The rotor 12 with its vanes 14, 15 is surrounded by a contour ring 18, which forms a stroke contour 16.

The stroke contour 16 is designed such that two crescent-shaped pumping chambers are formed, through which the vanes 14, 15 pass. Thus two pump sections are created, each with its own suction area and its own pressure area. During the operation of the vane cell pump 1, the pumped fluid is drawn into the suction area and put under pressure in the pressure area. The pressurized pumped fluid is then sent onward to a consumer. The consumer can be, for example, a power steering device, a transmission, or part of an internal combustion engine. The invention pertains both to single-stroke and to two-stroke vane cell pumps.

Figure 2:
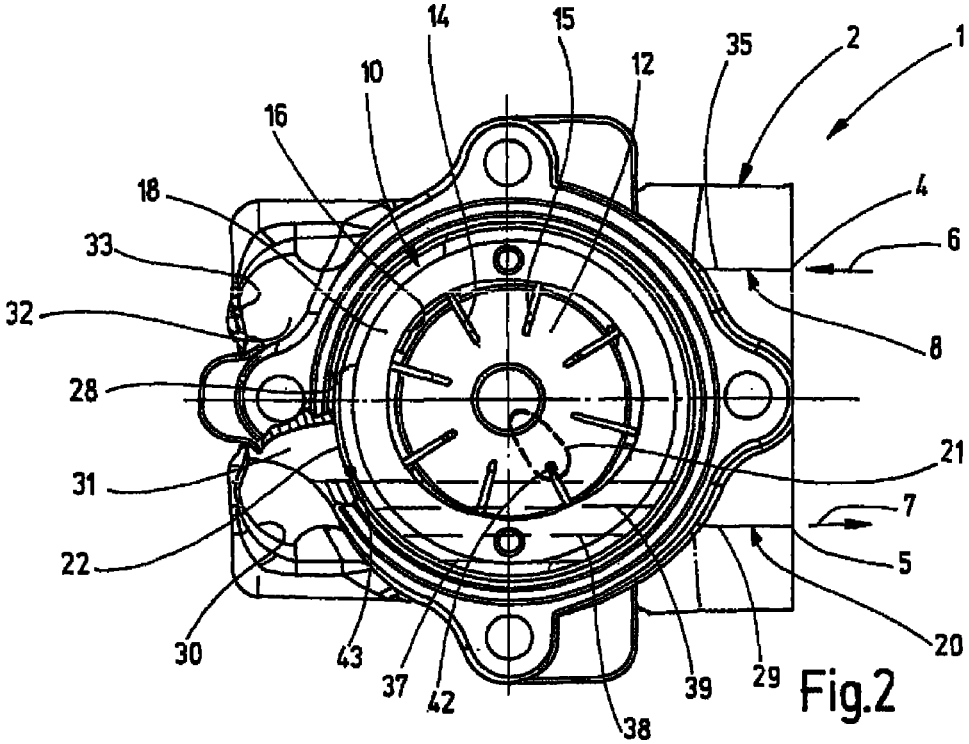
Figure 6:
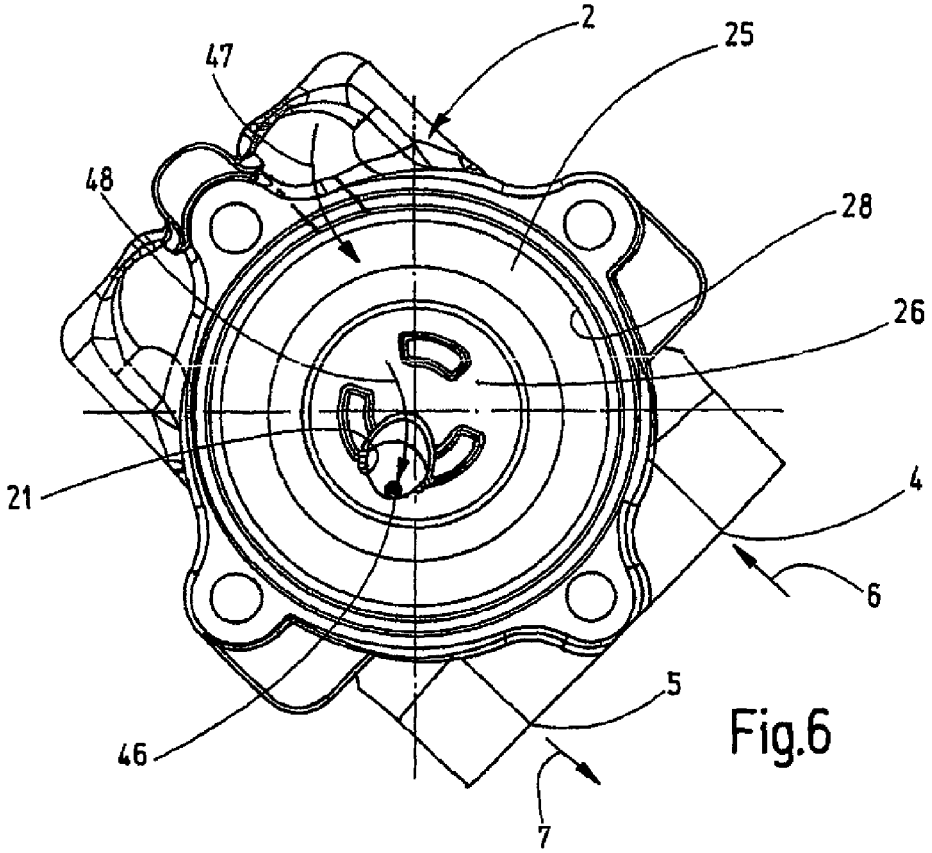
FIG. 6 is a view similar to that of FIG. 5 but without the rotor and without the side plate.
Figure 8:
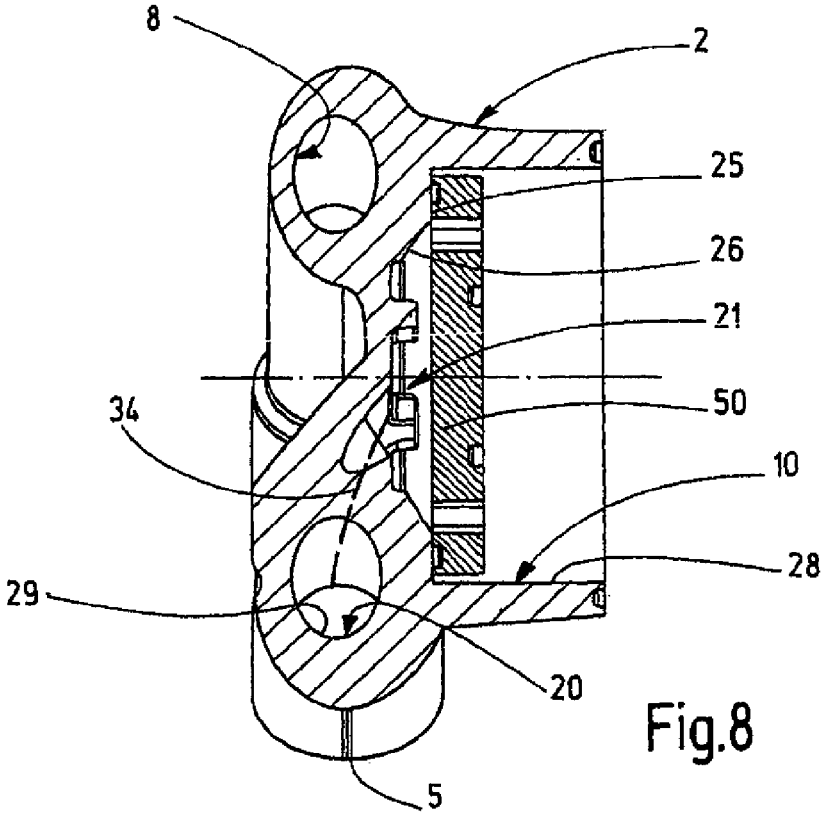
FIG. 8 is a cross-sectional view along line VIII-VIII of FIG. 7.

It can be seen in FIGS. 2, 6, and 8 that the pressure connection point 5 is connected to the receiving chamber 10 by a pressure channel 20, which has a pressure channel opening 21 leading to the receiving chamber 10. The pressure channel opening 21 is also connected to another pressure channel opening 22 by the pressure channel 20.

FIGS. 6 and 8 show that the pressure channel opening 21 is arranged in an end wall 25 of the pump housing 2, namely, in the area of a recess 26. The end wall 25 forms a boundary of the receiving chamber 10 in the axial direction. The term "axial direction" refers to the axis of rotation of the rotor of the vane cell pump. In the circumferential direction, the receiving chamber 10 is bounded by a circumferential wall 28, in which, as can be seen in FIG. 2, the additional pressure channel opening 22 is arranged.

The pressure channel 20 comprises a pressure connecting channel 29, that extends in a substantially straight line from the pressure connection point 5 through the pump housing 2 all the way to a closed end 30. The end 30 of the pressure connecting channel 29 is connected to the additional pressure channel opening 22 by a pressure connection area 31.

It can be seen in FIG. 1 that the suction channel opening 9 is connected in a similar manner by a suction connection area 32 to a closed end 33 of a suction connecting channel 35 extending in a straight line through the pump housing 2. With respect to the connection areas 31, 32, the suction channel 8 and the pressure channel 20 are designed in essentially the same way. Nevertheless, an additional pressure connection area 34 proceeds from the pressure connecting channel 29, as can be seen in FIGS. 6 and 8, and this additional pressure connection area connects the pressure connecting channel 29 to the pressure channel opening 21.

The starting properties of the vane cell pump 1, which is preferably designed to be self-priming, are supported by a so-called "siphon" effect in the pump housing 2. According to a preferred aspect of the invention, the positive properties of the siphon effect are maintained independently of the various positions in which the pump housing 2 can be installed, which are shown in FIGS. 1-7.

The connection points 4, 5, the channels 8, 20, and the channel openings 9, 21, 22 are arranged in the case of the pump housing 2 such that, with one and the same pump housing 2, it is possible to realize any installation position with respect to the rotation of the pump housing 2 from 0-360° around the axis of rotation of the rotor 12. As a result of the inventive design of the pump housing 2, it is guaranteed that, regardless of the installation position, the conveyed medium will always be at a certain minimum level sufficient to preserve the desired siphon effect. The broken lines 37, 38, and 39 designate the conveyed medium which remains in the pump housing 2 in the various installation positions.

In the case of the installation position shown in FIG. 1, a minimum level of the pumped fluid 37-39 is determined by an overflow point 41 at the suction channel opening 9. The connecting channels 29, 35 extend horizontally through the pump housing 2. The pressure connecting channel 29 is located above the suction connecting channel 35.

In FIG. 2, the position of the pump housing 2 is rotated 180° from the installation position shown in FIG. 1. The connecting channels 29 and 35 are again horizontal, but the suction connecting channel 35 is now arranged above the pressure connecting channel 29. In this position, the minimum level of the pumped fluid 37-39 is determined by an overflow point 42 at the pressure channel opening 21 and by another overflow point 43 at the additional pressure channel opening 22. It is also possible for the two overflow points 42, 43 and/or the associated pressure channel openings 21, 22 to be arranged on different levels. If the two overflow points or pressure channel openings are arranged on different levels, then the minimum level of pumped fluid is determined by the overflow point or pressure channel opening on the lower level.

Figure 3:
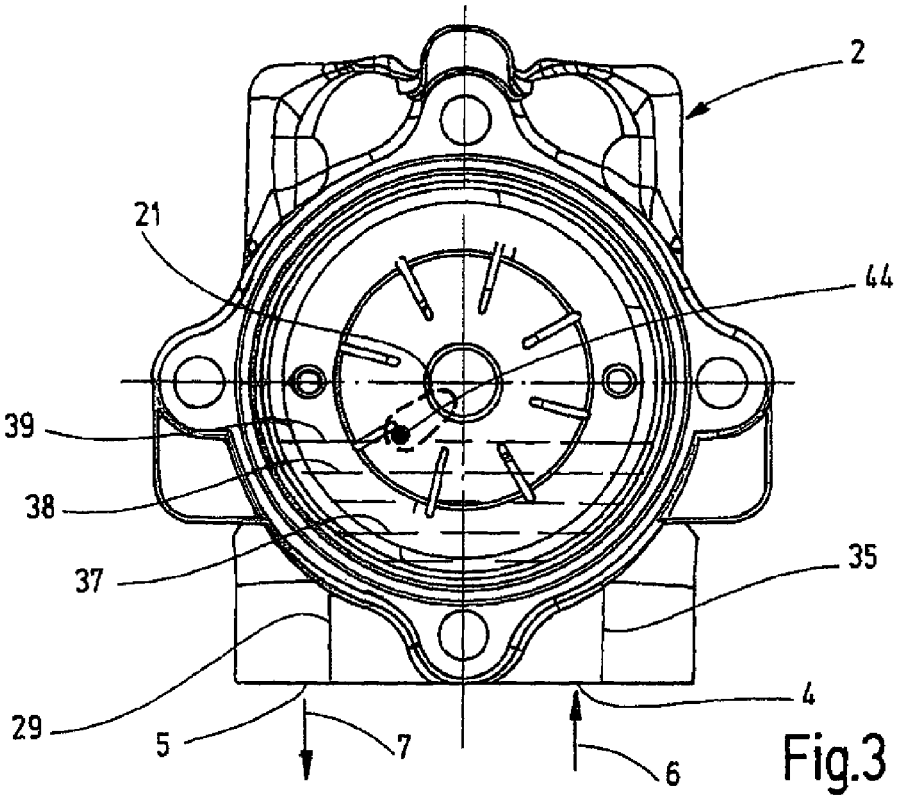

FIG. 3 shows an installation position of the pump housing 2 in which the connecting points 4, 5 are both at the bottom, so that the connecting channels 29, 35 are oriented vertically. In this installation position, the minimum level of pumped fluid 37-39 is determined by an overflow point 44 at the pressure channel opening 21. Because the additional pressure channel opening and the suction channel opening are both located above the pressure channel opening 21, they have no effect on the minimum level of the pumped fluid 37-39.

Figure 4:
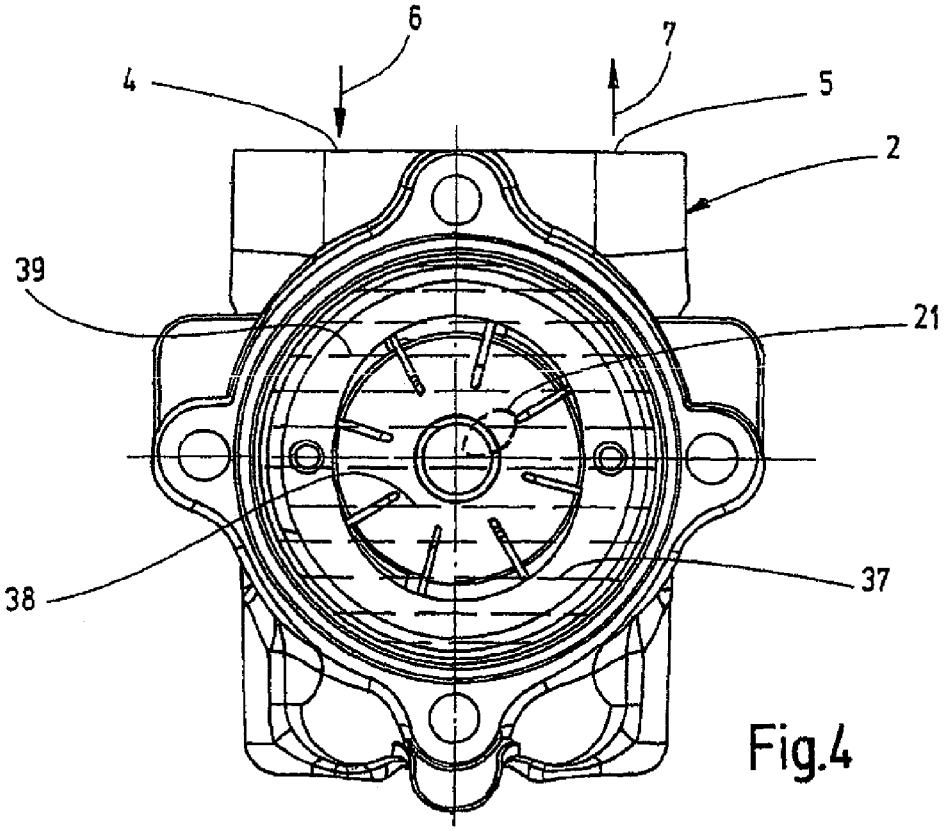

In FIG. 4, the pump housing 2 is rotated 180° from the installation position shown in FIG. 3, so that the connection points 4, 5 are now at the top. Accordingly, the minimum level of pumped fluid 37-39 is determined by the connection points 4, 5 themselves.

Figure 5:
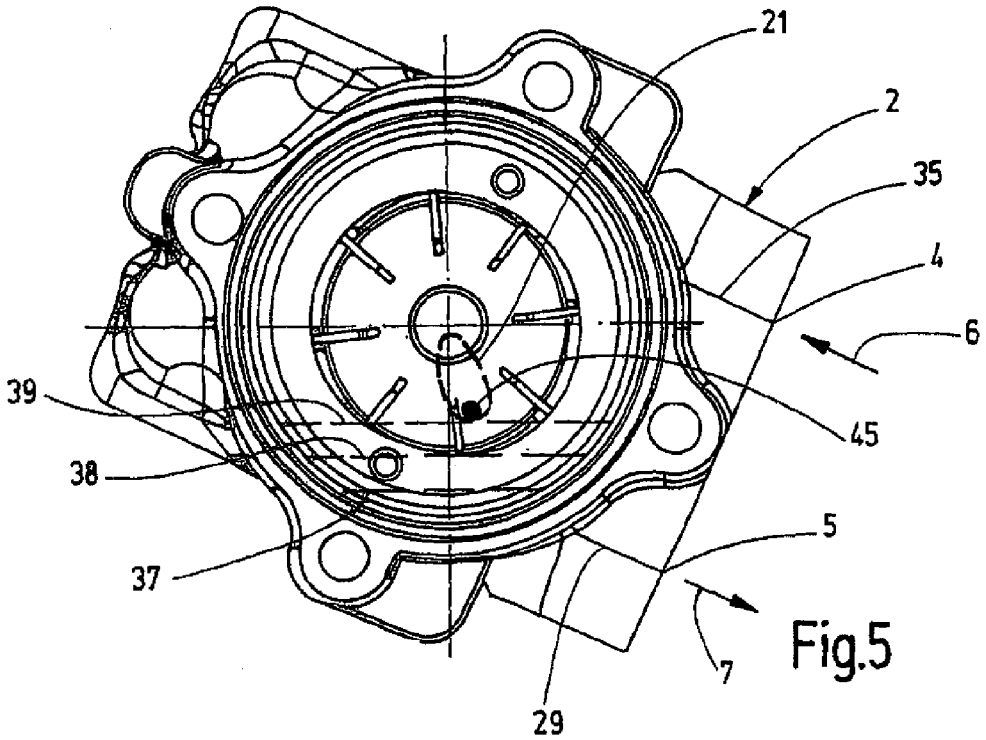

In FIG. 5, the position of the pump housing 2 is rotated in such a way that the connecting channels 29, 35 are arranged at an angle of approximately 25° to the horizontal, so that the pressure connection point 5 is below the suction connection point 4. In this position, the minimum level of the pumped fluid 37-39 is determined by an overflow point 45 at the pressure channel opening 21.

FIG. 6 shows an installation position similar to that of FIG. 5, wherein the pump housing 2 is shown without the rotary assembly, the view being from above, looking down onto the pressure channel opening 21. The arrows 47-48 indicate the flow through the pump housing 2. The minimum level is determined by an overflow point 46.

Figure 7:
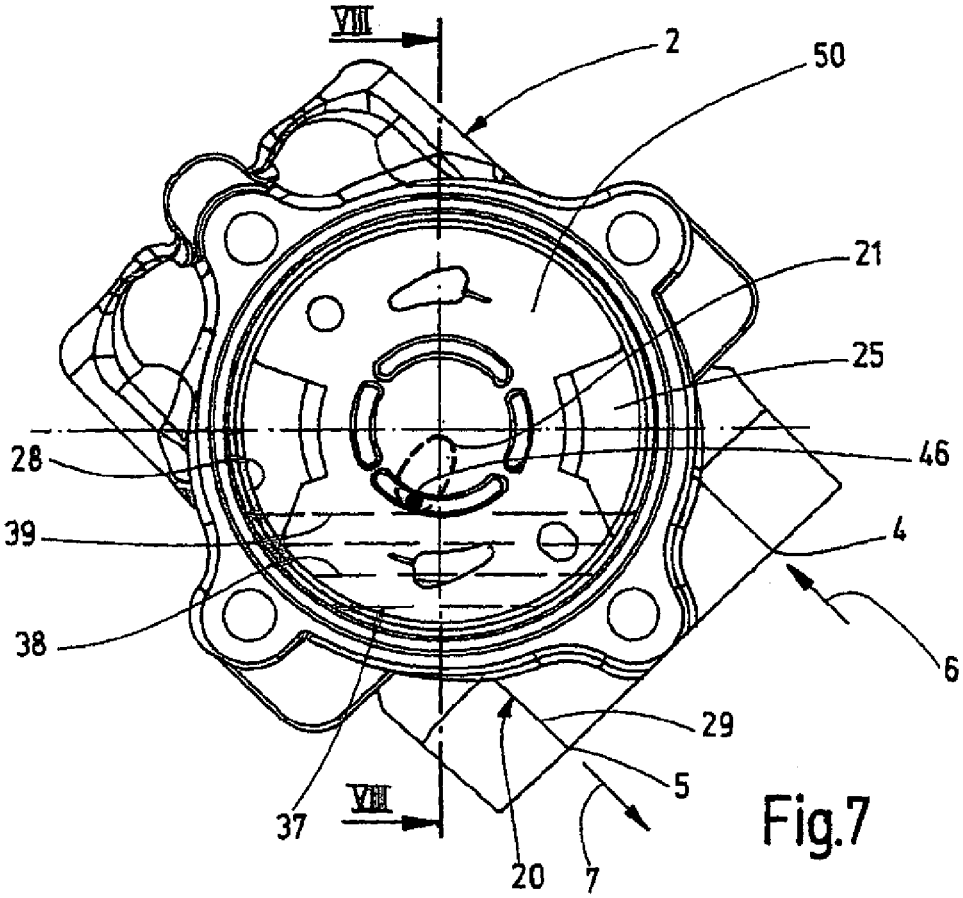
FIG. 7 is a view similar to that of FIG. 6 but with the side plate.

FIGS. 7 and 8 show that a side plate 50 rests against the end wall 25 in the receiving chamber 10. The installation position shown in FIG. 7 corresponds to the position shown in FIG. 6. The minimum level of pumped fluid 37-39 is determined by the overflow point 46 at the pressure channel opening 21. The pressure channel opening 21 is indicated only in broken line in FIGS. 1, 2, 3, 4, 5 and 7, because it is not actually visible in the views presented there.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A pump housing of a pump, comprising: a suction connection point; a suction channel arranged proceeding from the suction connection point; a suction channel opening arranged in the suction channel; a receiving chamber arranged in the pump housing, the receiving chamber coupled to the suction channel by the suction channel opening; a pressure channel opening; a pressure channel leading from the receiving chamber, the pressure channel coupled to the receiving chamber via the pressure channel opening; a pressure connection area from which the pressure channel proceeds; and an end wall of the pump housing forming a boundary of the receiving chamber in an axial direction, wherein at least one of the suction connection point, the pressure connection area, the suction channel opening, and the pressure channel opening is arranged so that an amount of pumped fluid present in the receiving chamber is maintained at a minimum level, regardless of an installation orientation, the minimum level being sufficient to preserve a siphon effect for self-priming of the pump, wherein the pressure channel opening is arranged in the end wall of the pump housing and the pressure channel opening is arranged at a location of the end wall that is within a circumference of the receiving chamber, wherein the pressure channel comprises another pressure channel opening arranged in a circumferential wall of the pump housing forming a boundary of the receiving chamber, wherein the pressure connection point is connected by a pressure connecting channel to the pressure connection area, wherein the pressure connection area is configured to connect an end of the pressure connecting channel facing away from the pressure connection point to the another pressure channel opening, wherein the suction channel opening is arranged in the circumferential wall of the pump housing forming a boundary of the receiving chamber, and wherein the suction connection point is connected by a suction connecting channel to a suction connection area, wherein the suction connection area is configured to connect an end of the suction connecting channel facing away from the suction connection area to the suction channel opening.

2. The pump housing according to claim 1, wherein an end of the pressure connecting channel facing away from a pressure connection point and the pressure connection area are located radially outside of, and axially offset from, the circumferential wall of the pump housing which forms a boundary of the receiving chamber.

3. The pump housing according to claim 1, wherein an end of the suction connecting channel facing away from the suction connection point and the suction connection point are arranged radially outside of, and axially offset from, the circumferential wall of the pump housing which forms a boundary of the receiving chamber.

4. The pump housing according to claim 1, wherein the suction connecting channel is parallel to the pressure connecting channel.

5. The pump housing according to claim 1, wherein the suction connecting channel and the pressure connecting channel extend in a same plane that is parallel to the end wall of the pump housing forming a boundary of the receiving chamber.

6. The pump housing according to claim 1, wherein the pump housing is a vane cell pump housing.

7. The pump housing according to claim 3, wherein the suction connecting channel is parallel to the pressure connecting channel.

* * * * *